US005562063A

United States Patent [19]

Graham

[11] Patent Number: 5,562,063

[45] Date of Patent: Oct. 8, 1996

[54] SAIL SUPPORT DEVICE

[76] Inventor: Robert G. Graham, Doves Bay Road, Kerikeri, New Zealand

[21] Appl. No.: 382,052

[22] PCT Filed: Aug. 5, 1993

[86] PCT No.: PCT/NZ93/00063

§ 371 Date: Feb. 10, 1995

§ 102(e) Date: Feb. 10, 1995

[87] PCT Pub. No.: WO94/03362

PCT Pub. Date: Feb. 17, 1994

[30] Foreign Application Priority Data

Aug. 10, 1992 [NZ] New Zealand ..... 243901

[51] Int. Cl.[6] ..... B63H 9/08

[52] U.S. Cl. ..... 114/105; 114/108; 114/112

[58] Field of Search ..... 114/102, 103, 114/105, 108, 113, 112, 104, 204

[56] References Cited

U.S. PATENT DOCUMENTS 1,647,813 11/1927 Reckmann ..... 114/112
3,658,025 4/1972 Hood et al. ..... 114/105
4,159,007 6/1979 Pelletier ..... 114/112
4,823,720 4/1989 Foster ..... 114/108

*Primary Examiner*—Sherman Basinger
*Attorney, Agent, or Firm*—Young & Thompson

[57] ABSTRACT

Sail support device comprising a plurality of slides (1) adapted to be retained to a sail (21) by webbing (8A). The slides (1) are accommodated in a groove (3) of a track member adapted for mounting on a stay (23). Each slide (1) has an elongate hollow body (2) with a longitudinal aperture through the wall thereof enabling an eye (20) formed by the webbing (8A) to be inserted into the body (2). A pin (9A) is insertable into the body (2) and through the eye (20) and locates in the body (2) to anchor the webbing (8A) thereto. A gate section (22) of the track member is rotatable about a connector joining sections (4A, 4B) of the track member together to expose open ends of grooves (3) enabling the slides (1) to be slid thereinto. With alignment of the grooves (3) of the gate section (22) with those of the track member, the sail (21) can be raised with slides (1) travelling up the full length of the track member.

7 Claims, 2 Drawing Sheets

10
16
17
12
2
6A
5
15
11
6
9
9A
13
14
14A
32
30
23
19
4
3
11A
7
8A
21
1
20
8
8A

SAIL SUPPORT DEVICE

This invention relates to yacht sails and in particular to support means by which a luff of a sail, particularly a foresail or jib, can be mounted to a yachts rigging. The invention utilises a sail support slide mounted in a track element for raising or lowering a sail, the combination being suitable for use with a roller furling means.

BACKGROUND ART

It is known to provide single and double track elements along a forestay to carry a sail thereon rather than the sail be carried directly on the stay. A double track element enables a first sail to be pre-loaded on one track in readiness for substitution for an already raised second sail on the other track. Further, sail furling means for such tracks are known, these operating by rotating a track member about a supporting stay and thereby roll-furling a sail about with the track. Devices relating to these arrangements are disclosed in U.S. Pat. No. 3,851,609 and other patents referred to therein and also in my U.S. Pat. No. 4,228,755.

Each of these known devices have drawbacks, for example, a disadvantage with a headsail having a luff edge incorporating a bolt rope slidingly mounted in an associated track such as disclosed in U.S. Pat. No. 3,851,609 can be the lack of control over the sail immediately upon lowering. More particularly, the continuous nature of the bolt rope requires substantially complete withdrawal of the luff of the sail from the associated track to achieve lowering. The result can be an unrestrained sail on a fore deck until appropriate storage can be achieved. To some extent this problem is overcome with a sail where the luff rope thereof is retained by spaced apart slides such as disclosed in my earlier patent aforesaid. However, such slides are not particularly suitable for use with roller furling apparatus as they form protrusions which can be detrimental to the fabric of a sail rolled thereabout. Further, as such slides are subject to tensile forces they are prone to fracture necessitating a generally robust structure utilising relatively expensive materials. For these reasons and because my earlier device incorporates a removable "pre-loadable" magazine which registers with a lower end of the supporting stay my earlier arrangement, in particular the slide, is not considered particularly suitable for use with roller furling apparatus.

Another unit is disclosed in U.S. Pat. No. 3,800,728 which has a similar removable "pre-loading" section, but with only one track, and is thus also not suitable for use with roller furling. Further, the slide of this patent includes an extending section by which a sail is affixed thereto and this would cause protrusions if used with roller furlong apparatus.

An object of this invention is to provide a sail support means which enables the advantages of sail track elements to be utilised With roller furling means and which also provides for controlled retention of a luff of a sail with lowering of a sail down an associated track. In particular it is an object of this invention to provide a sail support slide for use in such mechanisms.

SUMMARY OF THE INVENTION

According to a first aspect of this invention there is provided a sail support slide comprising an open ended elongate hollow body incorporating a longitudinally disposed aperture through a peripheral wall thereof, a projection formed on an exterior face of the wall adjacently about the aperture to form an extension thereof, a sail attachment restraint mountable in the open ends of the body to extend therebetween in substantially parallel disposition to the aperture and in spaced relationship to an inner face of the peripheral wall as can anchor a sail attachment means, inserted through the aperture into the interior of the body, to the slide.

According to a second aspect of this invention there is provided sail support means comprising a track element adapted for longitudinal mounting to a yacht rigging stay and incorporating at least one longitudinally extending groove to slidingly retain therein a plurality of slides each having an open ended elongate hollow body incorporating a longitudinally disposed aperture through a peripheral wall thereof, a projection formed on an exterior face of the wall adjacently about the aperture to form an extension thereof extending into but not substantially beyond a mouth opening of the groove, a sail attachment restraint mountable in the open ends of the body to extend therebetween in substantially parallel disposition to the aperture and in spaced relationship to an inner face of the peripheral wall as can anchor a sail attachment means, formed by a length of webbing affixed to a luff of a sail to project as a closed loop therefrom with an eye forming section of the webbing being inserted through the aperture into the interior of the body, to a slide, the sail attachment means being provided at spaced apart intervals along a luff edge of a sail and each being anchored to an associated slide.

DETAILED DESCRIPTION OF THE INVENTION

Figure 3:
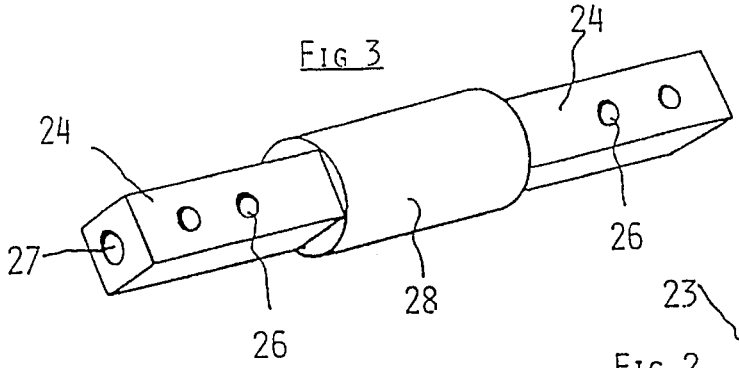
FIG. 3 is a perspective view of track joiner adapted to form part of a slide loading and unloading gate of the device.

Referring in particular to FIGS. 5 to 8 a slide 1 comprises a body 2 preferably moulded from suitable plastics material to a generally hollow tubular form some 60 mm in length and of a diameter of some 12 mm. More particular the diameter of slide 1 is determined to be a sliding fit within a commensurately shaped groove 3 in an associated track element 4. An aperture 5 is formed through the peripheral wall of the body 2 with preferably aperture 5 extending longitudinally for substantially the full length of body 2. Aperture 5 continues through an extension of the peripheral wall, the extension being formed by a pair of adjacently spaced apart flanges 6 preferably joined together at their ends 6A. Referring in particular to FIG. 4, flanges 6, in situ, extend through but not substantially beyond a mouth or opening 7 of a groove 3 and thereby protect a sail 21 attachment means 8 mounted thereto from rubbing or otherwise wearing on the edges of the track 4 forming the mouth 7.

Figures 4, 5, 6, 7, 8:
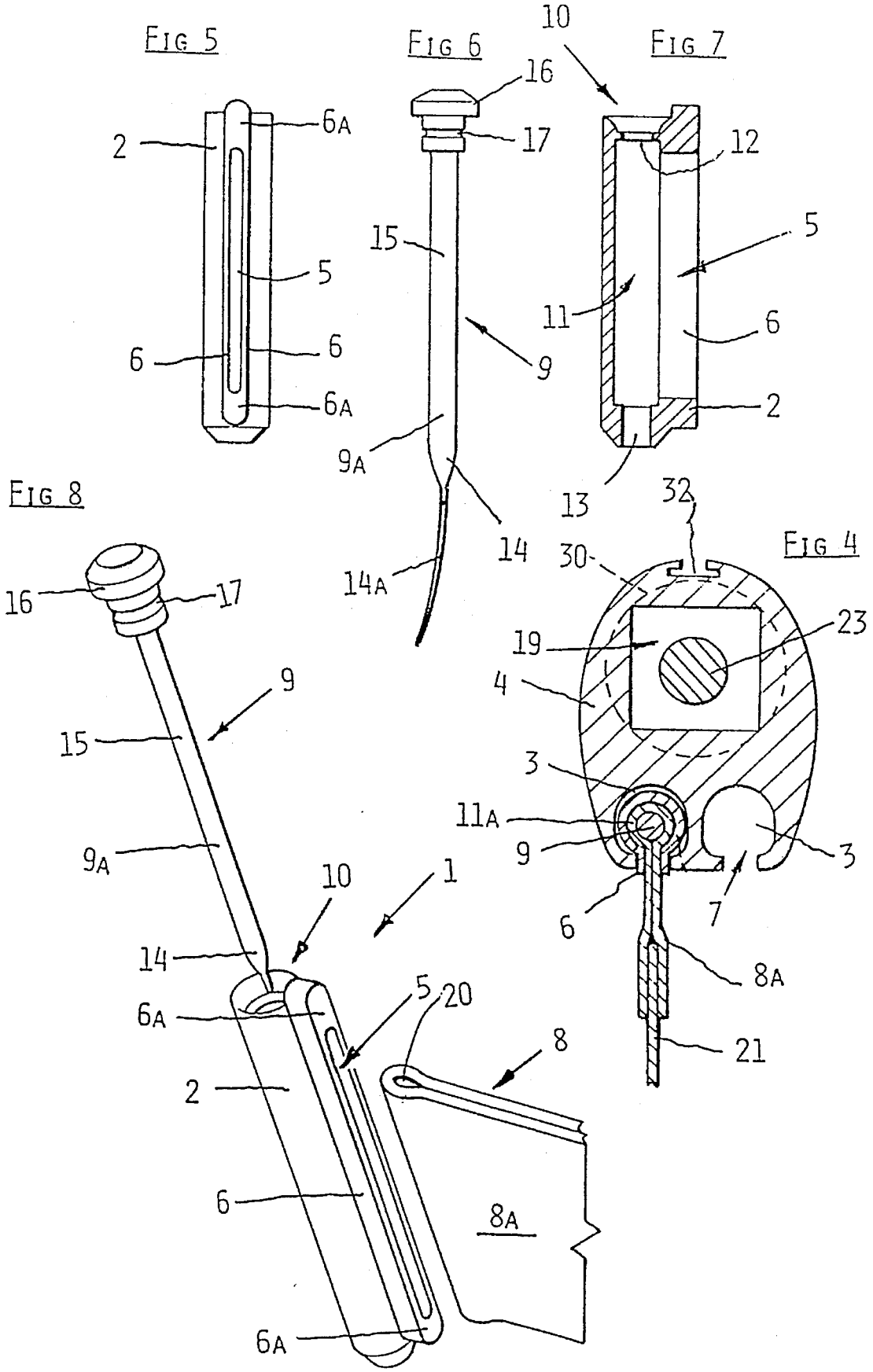
FIG. 4 is a cross-sectional view on line A—A on FIG. 1, and FIGS. 5 and 6 are side views of a body and a restraint pin of a slide respectively, and FIG. 7 a longitudinal-sectional view of the slide body.
FIG. 8 is an exploded perspective view of the slide.

Sail 21 attachment restraint means 9 are mountable in the body 2 to anchor a sail attachment means 8 inserted through aperture 5. Preferably body 2 is open ended with an opening 10 at one end of a bore 11 of the body 2 incorporating a reduced throat section 12 and an opening 13 at the opposing end of bore 11 being of a reduced diameter to that of bore 11. Referring in particular to FIGS. 6 and 8, preferably a headed pin 9A is utilised as the sail attachment restraint 9, pin 9A being insertable in the opening 10 of the body 2 to extend through the bore 11 thereof to locate a toe 14 of pin 9A in the opening 13. The shank 15 of pin 9A is of a diameter considerably less than that of bore 11. Thus, when pin 9A is mounted as aforesaid an annular space 11A (depicted in FIG. 4 as being taken-up by sail attachment means 8) is provided about pin 9A. Preferably a head 16 of pin 9A incorporates an annular groove 17 disposed to snap-fit in throat 12 to engage pin 9*a* in body 2, Referring in particular to FIG. 1, the preferred form of sail attachment means 8 is a length of webbing 8A with the end sections attached, such as by stitching 18, to a sail 21 to extend as an eye 20 (see FIG. 8) therefrom. Preferably the width of webbing 8A is commensurate to the length of aperture 5 and eye 20 thereof is inserted therethrough to locate within bore 11. Anchoring of a sail attachment means 8 is achieved by insertion of pin 9A into the bore 11 as aforesaid and in so doing through eye 20. Anchoring is completed with location of toe 14 of pin 9A in opening 13 and the engagement of throat 12 within groove 17. Preferably a fine "needle" extension 14A is provided on toe 14 of pin 9A to facilitate location of pin 9A through eye 20. Preferably the extension 14A is removed after exiting the opening 13.

Referring in particular to FIGS. 1–4 inclusive, a track 4 is preferably formed from extruded aluminium to a generally ovoid cross-sectional configuration with a longitudinal bore 19 extending therethrough. Preferably two grooves 3 are formed in an aft or trailing section thereof, the grooves 3 being of an undercut configuration to form mouth 7 thereto. A track 4 is mounted to a stay 23 which extends through bore 19, track 4 thus being able to rotate about stay 23. Track 4 is conventionally comprised of several sections of track 4 extrusions joined end to end on a stay 23. A connector (similar to that depicted in FIG. 3 but without the journal section 28) is preferably utilised to join the sections of a track member 4 together. Spigot like end sections 24 of a connector are located in the ends of the bore 19 of each track 4 section and rivets 25 or similar fixing members are extended through the track 4 sections to locate in apertures or indentations 26 formed in the connector. A bore 27 is formed through the connector to accommodate stay 23 therethrough.

Figure 1:
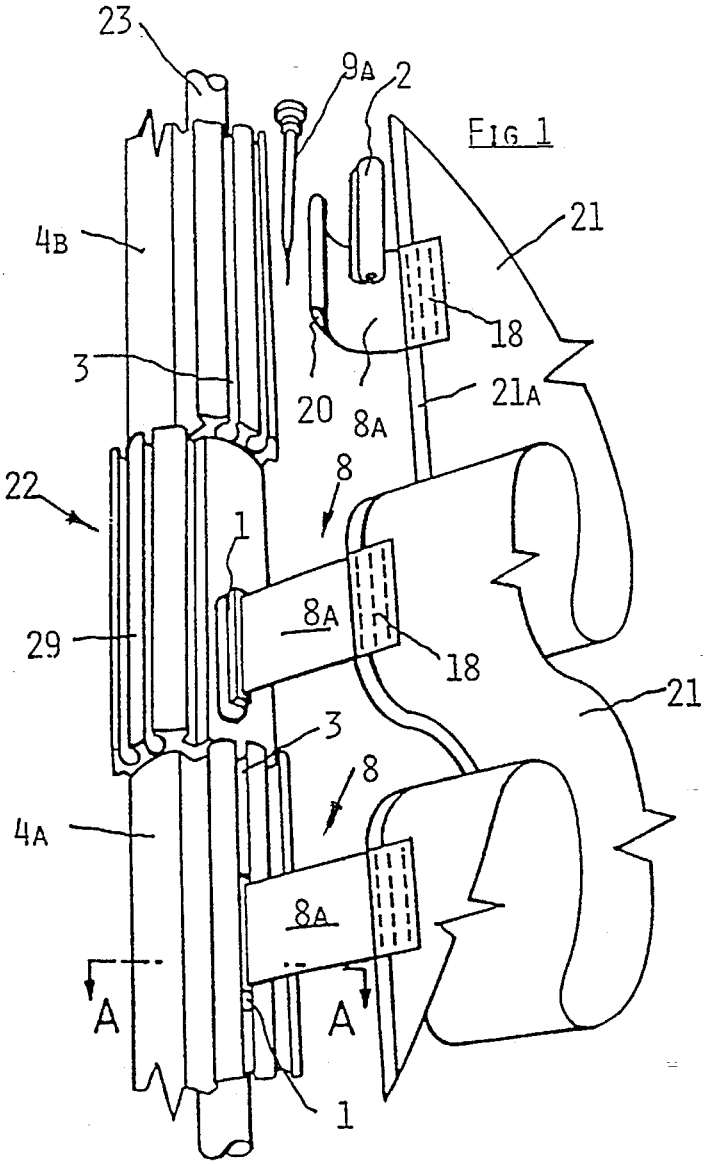
FIG. 1 is a fragmented perspective view of the device With, for clarity, one slide being shown in exploded form.
Figure 2:
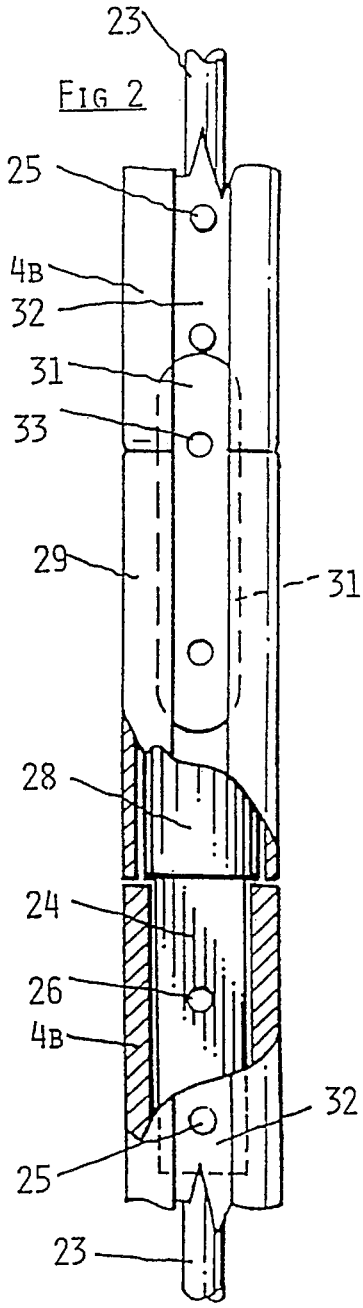
FIG. 2 is a front fragmented view including, for clarity, a cut-away section.

One such connector, being that depicted in FIG. 3, is adapted to form a gate 22 by which slides 1 can be loaded into a groove 3. To that end a journal 28 is formed thereon between the spigot ends 24. Journal 28 is preferably some 100 mm in length and a section of track 4 extrusion of a corresponding length is adapted to form a rotatable barrel 29 for mounting thereon. Barrel 29 is adapted by boring-out (as indicated by phantom line 30 on FIG. 4) bore 19 to a diameter corresponding to that of journal 28. Thus barrel 29 can be longitudinally mounted onto journal 28 when joining track 4 sections together as depicted in FIG. 1. Barrel 29 can be rotated on journal 28 to expose "end" openings to the grooves 3. A keeper in the nature of a longitudinally slidable plate 31 is mounted in a groove 32 formed on the front of track 4 sections to bridge the junction between barrel 29 and one adjacent section of track 4. This enables barrel 29 to be locked in place with the grooves 3 of barrel 29 aligning with the grooves 3 of the remainder of the track 4. Suitable detents 33 are provided on plate 31 to prevent its inadvertent dislodgement.

In situ, preferably the spacing of gate 22 from a lower end of stay 23 is sufficient to provide a length of track 4A beneath gate 22 which will accommodate all the slides 1 of a sail 21. Thus, referring in particular to FIG. 1, in loading a sail 21 into a groove 3 a lower of the slides 1 is lowered first through the upper exposed end opening of a groove 3 of lower track section 4A. A next lowermost slide 1 and so on of a sail 21 are lowered into track section 4A to stack the slides 1 essentially one immediately above the next therein to thus retain the luff 21A of sail 21. With barrel 29 rotated back into the aligned groove mode a sail 21 may be raised in conventional manner into and fully along the upper section 4B of a track 4. By this arrangement of captivating the webbing 8A within a slide 1 and capturing the slide 1 within a groove 3 it will be seen a compressive anchoring of a sail 21 to a track 4 is provided.

Where suitable roller furling means (not depicted) are provided it will be seen that slides 1 do not stand proud of track 4 and this together with the web nature of sail restraint means 8A enables a concentrated or close rolling or furling of a sail 21 about a track 4.

I claim:

1. A sail support slide comprising a slidable open ended elongate hollow body incorporating a longitudinally disposed aperture through a peripheral wall thereof, a projection formed on an exterior face of the wall adjacently about the aperture to form an extension thereof, a sail attachment restraint mountable in the open ends of the body to extend therebetween in substantially parallel disposition to the aperture and in spaced relationship to an inner face of the peripheral wall to anchor a sail attachment means, inserted through the aperture into the interior of the body, to the slide, said sail attachment restraint being in the form of a headed pin with a head of the pin incorporating interlock means, the pin being mountable in the body through one of the open ends thereof, that end incorporating a complementary interlock means adapted to engage with the interlock means of the pin when mounted therein, a toe of the pin locating in the opposing open end of the body.

2. A sail support slide as claimed in claim 1 wherein the sail attachment restraint is, in situ with the mounting thereof in the body, adapted to be inserted through an eye formed in a portion of the sail attachment means inserted into the interior of the body.

3. A sail support means comprising a track element adapted for longitudinal mounting to a yacht rigging stay and incorporating at least one longitudinally extending groove to slidingly retain therein a plurality of slides as claimed in claim 1 with the projection of a slide extending into but not substantially beyond a mouth opening of the groove.

4. A sail support means as claimed in claim 3 wherein a sail attachment means is formed by a length of webbing with end sections thereof adapted to be affixed to a luff of a sail to project as a closed loop therefrom, an eye forming section of the webbing being inserted through the aperture.

5. A sail support means comprising a track element adapted for longitudinal mounting to a yacht rigging stay and incorporating at least one longitudinally extending groove to slidingly retain therein a plurality of slides each having an open ended elongate hollow body incorporating a longitudinally disposed aperture through a peripheral wall thereof, a projection formed on an exterior face of the wall adjacently about the aperture to form an extension thereof extending into but not substantially beyond a mouth opening of the groove, a sail attachment restraint mountable in the open ends of the body to extend therebetween in substantially parallel disposition to the aperture and in spaced relationship to an inner face of the peripheral wall as can anchor a sail attachment means, said sail attachment means being formed by a length of webbing affixed to a luff of a sail to project as a closed loop therefrom with an eye forming section of the webbing being inserted through the aperture into the interior of the body, the sail attachment means being provided at spaced apart intervals along a luff edge of a sail and each being anchored to an associated slide.

6. A sail support means as claimed in claim 5 wherein the track incorporates a slide loading gate consisting of a section of track rotatably mounted on a medially journal section of a connector having end sections inserted into adjacent ends of track sections rotation of the gate exposing open ends of said at least one groove enabling insertion of slides thereinto, a keeper being provided on the gate to lock the gate with a groove thereof aligned with the groove of the track.

7. A sail support as claimed in claim 6 wherein, in situ, the gate is disposed above a length of track which will accommodate all the slides of a sail stacked one above the other.

* * * * *